United States Patent [19]

Ralston

[11] 4,270,507

[45] Jun. 2, 1981

[54] CHARGE FORMING APPARATUS

[75] Inventor: Ronald R. Ralston, Elmhurst, Ill.

[73] Assignee: Borg-Warner Corporation, Chicago, Ill.

[21] Appl. No.: 59,871

[22] Filed: Jul. 23, 1979

[51] Int. Cl.[3] ..... F02M 7/14; F02M 7/12

[52] U.S. Cl. ..... 123/523; 261/36 A

[58] Field of Search ..... 123/133, 136, 128, 523; 261/36 A, DIG. 39, 78 R

[56] References Cited

U.S. PATENT DOCUMENTS

| | | | |
|---|---|---|---|
| 1,923,429 | 8/1933 | Ericson | 261/36 A |
| 3,540,701 | 11/1970 | Brenneke | 261/36 A |
| 3,785,627 | 1/1974 | Tuzson | 261/36 A |
| 3,965,221 | 6/1976 | Englert | 261/36 A |
| 3,977,382 | 8/1976 | Tuzson | 261/36 A |
| 4,130,610 | 12/1978 | Paul | 261/36 A |

FOREIGN PATENT DOCUMENTS

| | | | |
|---|---|---|---|
| 2820438 | 11/1978 | Fed. Rep. of Germany | 261/36 A |

*Primary Examiner*—Ronald H. Lazarus
*Attorney, Agent, or Firm*—Aubrey L. Burgess

[57] ABSTRACT

Charge forming apparatus of the fluid jet type in which the tubular supply member is acutely angled with respect to the housing passageway and the slot therein is located closely adjacent to the passageway wall and to a location of initial opening of the pivoted butterfly valve in the passageway which controls the air flow across the slot and through the passageway.

2 Claims, 1 Drawing Figure

CHARGE FORMING APPARATUS

BACKGROUND OF THE INVENTION

Charge forming apparatus of the fluid jet type in which fuel is stripped from a slot in a supply tube positioned across a passageway by a controlled velocity air stream through the passageway are well known in the art. For example, U.S. Pat. Nos. 3,785,627 granted to Tuzson and Hallberg on Jan. 15, 1974; 3,977,382 granted to Tuzson and Hallberg on Aug. 31, 1976; and 4,130,610 granted to Paul on Dec. 19, 1978 are examples of such charge forming apparatus or fuel systems.

An important consideration in such apparatus is to provide sufficient fuel to an engine for start, idle and low speed conditions as well as to above idle conditions.

THE INVENTION

In a fluid jet charge forming apparatus to efficiently supply fuel to an engine for start, idle and low speed conditions, it is proposed, according to this invention to position the transverse fluid jet supply tube at an acute angle to the wall of the cylindrical housing through which air flows to strip fuel from an upwardly directed slot in the supply tube. Also, the slot is positioned closely adjacent to the wall and closely adjacent to the initial opening location of the butterfly valve or throttle plate. The jet tube is so positioned that it does not interfere with the throttle plate and the slot is at the lowermost end of the tube and thus closely adjacent to the passageway wall and the location of initial opening of the valve.

At start, idle and low speed conditions, and when the butterfly valve initially opens, the quantity of air flowing through the passageway is relatively low but the velocity is relatively high because of the restricted passageway. The high velocity air, because of the positioning of the jet supply tube and its slot, strips sufficient fuel from the slot to satisfy the requirements of the engine for the engine conditions; i.e., start, idle and low speed conditions. Likewise when the butterfly valve is more fully opened and the quantity of air is greater and its velocity is lower, the jet tube continues to provide the required amount of fuel to the engine.

THE DRAWING

The sole FIGURE of the drawing illustrates partly schematically and partly in section apparatus constructed according to this invention.

DETAILED DESCRIPTION

Figure 1:
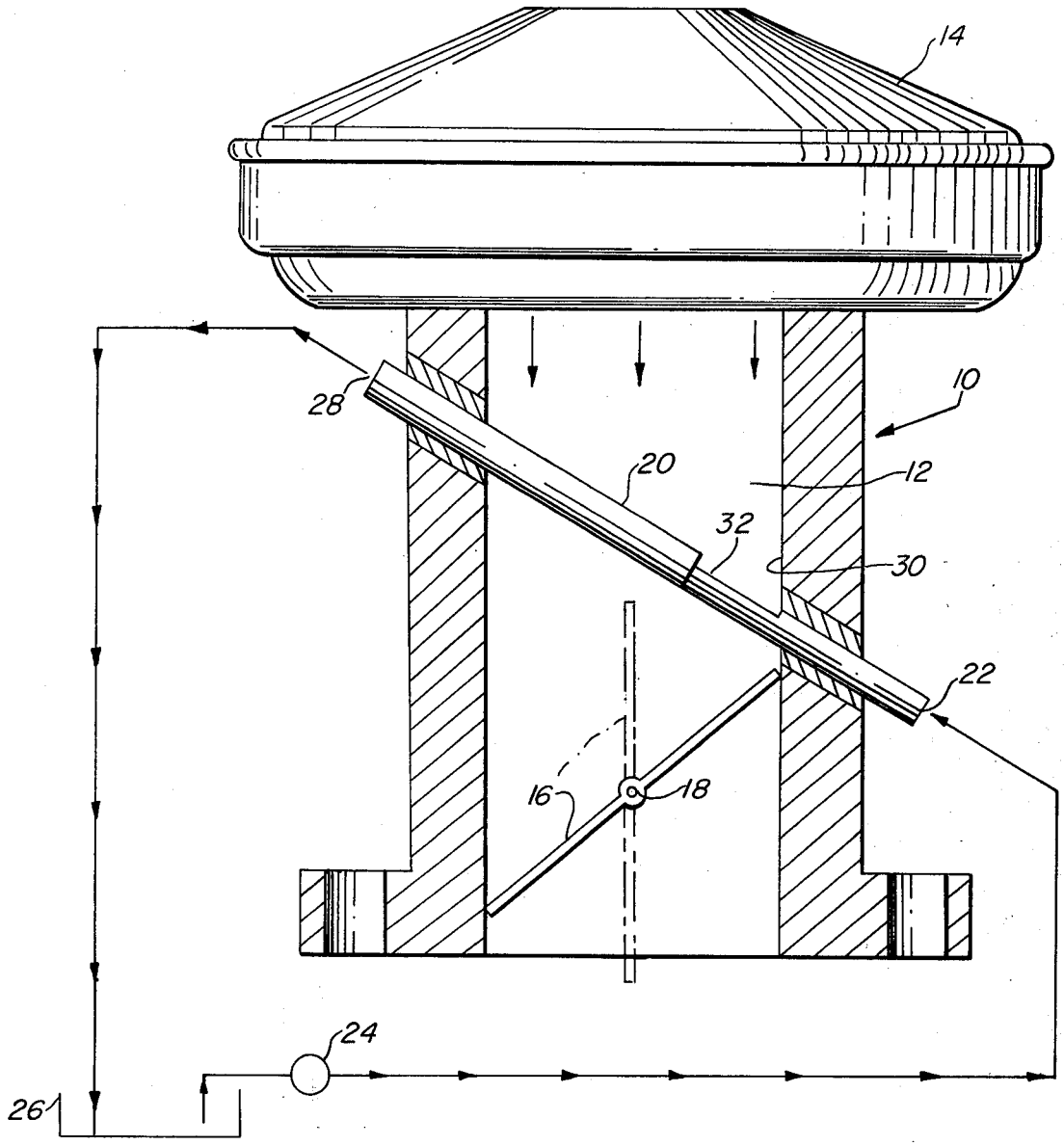

Attention is invited to the single FIGURE of the drawing which shows a throttle housing 10 having a central, generally cylindrical passageway 12 therethrough which receives air flowing through an air cleaner 14 and to an engine, not shown. The direction of air flow is indicated by appropriate arrows. A generally circular and state of the art throttle plate or valve 16 is pivoted about a shaft 18, the position of the plate being controlled in the usual manner as well known in the art.

A tubular member 20 is connected at its inlet end 22 to a fuel pump 24 which pumps fuel from a fuel source 26. Excess fuel flows from the other end 28 of the member 20 to the source 26. The member 29 is positioned above the valve 16 and at an acute angle to the wall 30 of the passageway 12. The member 20 is provided with a generally upwardly directed slot 32 positioned closely adjacent to the wall 30 and to one location of initial opening of the valve 16.

As usual in this type of charge forming apparatus, an excess quantity of fuel is delivered to the member 20 and the fuel in the slot 32 is exposed to the relatively high velocity of air flowing through the passageway 12. The air strips fuel from the slot 32; excess fuel returns to the source 26.

The lateral extent of the slot 32 may be adjustable as is known from the prior art referred to previously herein.

I claim:

1. In a charge forming apparatus where fuel is supplied to one end of a generally tubular member positioned across a housing passageway having a generally cylindrical wall and where said tubular member has a generally upwardly directed slot over which air flows and strips fuel therefrom, excess fuel flowing from the other end of the tubular member to a return and to a fuel source, and where the quantity of air flowing across the slot is controlled by a butterfly valve having a pivoting vane spaced from the tubular member, the improvement comprising:

locating said tubular member across said passageway at an acute angle to said housing wall with said slot at the lowermost and supply end and closely adjacent to said wall.

2. In a charge forming apparatus as recited in claim 1 wherein said butterfly valve comprises a circular member pivoted about a diameter thereof so as to initially open at diametrically opposed portions of said wall, said slot being located adjacent to one of the locations of initial opening of said valve.

* * * * *